US009538277B2

(12) United States Patent
Seo et al.

(10) Patent No.: US 9,538,277 B2
(45) Date of Patent: Jan. 3, 2017

(54) METHOD AND APPARATUS FOR CONTROLLING A SOUND INPUT PATH

(71) Applicant: Samsung Electronics Co., Ltd., Gyeonggi-do (KR)

(72) Inventors: Changhwan Seo, Gyeonggi-do (KR); Jeongseok Park, Seoul (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 170 days.

(21) Appl. No.: 14/243,230

(22) Filed: Apr. 2, 2014

(65) Prior Publication Data

US 2014/0321673 A1 Oct. 30, 2014

(30) Foreign Application Priority Data

Apr. 30, 2013 (KR) ..... 10-2013-0048722

(51) Int. Cl.
*H04R 1/10* (2006.01)

(52) U.S. Cl.
CPC ..... *H04R 1/1041* (2013.01)

(58) Field of Classification Search
None
See application file for complete search history.

(56) References Cited

U.S. PATENT DOCUMENTS 6,122,369 A 9/2000 Hwang et al.
2002/0090972 A1* 7/2002 Kuramatsu ..... H04M 1/578 455/550.1
2004/0100275 A1* 5/2004 Shin ..... H04R 5/04 324/538
2006/0233383 A1* 10/2006 Lee ..... H04R 5/04 381/58
2007/0098184 A1* 5/2007 Ibe ..... H04R 5/04 381/77
2009/0182908 A1* 7/2009 Sherman ..... G06F 13/4068 710/51
2010/0075723 A1* 3/2010 Min ..... H01R 24/58 455/569.1
2010/0194561 A1* 8/2010 Motoyama ..... H04M 1/6058 340/540
2010/0272252 A1 10/2010 Johnson et al.
2010/0303251 A1 12/2010 Im et al.
2011/0135109 A1* 6/2011 Park ..... H01R 13/641 381/74
2012/0070014 A1 3/2012 Choi
2012/0294454 A1* 11/2012 Sakamoto ..... H04R 1/1041 381/66
2013/0089216 A1* 4/2013 Han ..... H04R 29/001 381/74

(Continued)

*Primary Examiner* — Thang Tran
(74) *Attorney, Agent, or Firm* — Cha & Reiter, LLC

(57) ABSTRACT

A method and apparatus for controlling a sound input path in an electronic device. The method includes detecting a connection of an earphone device to an earphone interface; detecting a sound input through an earphone microphone, when detecting the connection of the earphone device. The earphone microphone is selected as a sound input device, when detecting the sound input through the earphone microphone. A built-in microphone of the electronic device is selected when the sound input through the earphone microphone is not detected.

15 Claims, 5 Drawing Sheets

(56) References Cited

U.S. PATENT DOCUMENTS

| | | | | |
|---|---|---|---|---|
| 2013/0236027 | A1* | 9/2013 | Tao | H04W 52/0241 381/74 |
| 2014/0064512 | A1* | 3/2014 | Yu | H01R 24/58 381/74 |
| 2014/0301562 | A1* | 10/2014 | Tu | H04R 3/00 381/74 |

* cited by examiner

METHOD AND APPARATUS FOR CONTROLLING A SOUND INPUT PATH

CLAIM OF PRIORITY

This application claims the benefit of priority under 35 U.S.C. §119(a) from a Korean patent application filed on Apr. 30, 2013 in the Korean Intellectual Property Office and assigned Serial No. 10-2013-0048722, the entire disclosure of which is hereby incorporated by reference in its entirety.

BACKGROUND

1. Technical Field

The present disclosure relates to a method for controlling a sound input path and an apparatus supporting the same. More particularly, the present disclosure relates to a method for controlling a sound input path for an electronic device and an apparatus supporting the same.

2. Background

A portable terminal is extremely popular due to its various communication functions and a size which is typically small enough to carry. In response to consumer demand, the size of touch screens is projected to increase, and a development of associated hardware and software that may provide various contents, the portable terminal is undergoing a dramatic growth and is becoming more popular than ever.

Meanwhile, an earphone device is provided as an accessory device for the portable terminal. The user of a portable terminal may listen to an audio signal by connecting the earphone device to the portable terminal through the earphone device for private listening, and user sound or an external sound may be input to the portable terminal through a microphone equipped in the earphone.

When mounting a 3.5. mm earphone that is currently used as a standard for the current smart phone, the smart phone uses a logic circuitry that detects a type of the earphone connected thereto in order to determine the sound input device in a state in which the earphone is mounted. In other words, when the earphone is connected to the smart phone, the smart phone detects a type of the earphone by dividing whether the earphone is a microphone-type (4-pole) or non-microphone-type (3-pole), and determines the sound input device as the earphone microphone when the earphone is detected as a microphone type. In addition, with regard to the non-microphone-type earphone, the smartphone may determine the sound input device as being a microphone that is built-in to the smart phone when the earphone is detected as a non-microphone-type.

Likewise, the method for distinguishing the earphone-type utilizes an electrical signal of a microphone terminal (M) section among the section divided by a left side output terminal (L), a right side output terminal (R), a ground terminal (G) of a 3.5 pie earphone, and an earphone microphone terminal (M). When a signal range of the microphone-type earphone is previously fixed at a certain range, and a corresponding electrical signal exists within the fixed signal range, the smartphone determines that the earphone of the microphone-type is mounted, and the earphone-microphone terminal (M) is determined as the sound input device.

In this case, even when the earphone microphone does not operate normally due to a malfunction, there is a problem in that a user-made sound or an external sound cannot be input because the earphone-microphone terminal (M) is activated as the sound input device.

In addition, when a deviation occurs in the electrical signal which is read in the earphone-microphone terminal (M) according to the earphone manufacturer and a circuit design of the smart phone, there is a problem of not being able to distinguish the type of the earphone accurately, and of tuning the signal range for detecting the microphone type according to each model when releasing the smart phone.

SUMMARY

Accordingly, the present disclosure o provide at least the advantages described below by providing a method for controlling a sound input path that supports to select a sound input device of an electronic device adaptively by checking whether a sound input through an earphone microphone is received and an apparatus supporting thereof.

The present disclosure further provides a method for controlling a sound input path that supports performance of a sound input function of an electronic device normally all the time by replacing a built-in microphone of an electronic device as a sound input device even when a microphone earphone is connected to an abnormally operating 4-pole earphone and an apparatus supporting thereof.

In accordance with an aspect of the present disclosure, a method for controlling a sound input path is provided. The method may include detecting a connection of an earphone device to an earphone interface; detecting a sound input through an earphone microphone, when detecting the connection of the earphone device; and selecting the earphone microphone as a sound input device, when detecting the sound input through the earphone microphone In accordance with another aspect of the present disclosure, an apparatus for controlling a sound input path is provided. The apparatus includes an earphone interface configured to sense a connection of an earphone; and a controller configured to detect a sound input that is input through an earphone microphone when sensing the earphone connection and configured to select a sound input device according to a detection result.

BRIEF DESCRIPTION OF THE DRAWINGS

The objects, features and advantages of the present disclosure will become more apparent to a person of ordinary skill in the art from the following detailed description in conjunction with the accompanying drawings, in which.

DETAILED DESCRIPTION

Exemplary embodiments of the present disclosure are described with reference to the accompanying drawings shown in detail. The same reference numbers are used throughout the drawings to refer to the same or like parts. Detailed descriptions of well-known functions and structures incorporated herein may be omitted to avoid obscuring appreciation by a person of ordinary skill in the art of the subject matter of the present disclosure.

Hereinafter, "mounting" or "connection" is defined as a state where an earphone device has been inserted to an earphone interface of a terminal. In addition, "dismounting", "detachment", or "disconnection" is defined as a state where an earphone device is separated from an earphone interface.

Figure 1:
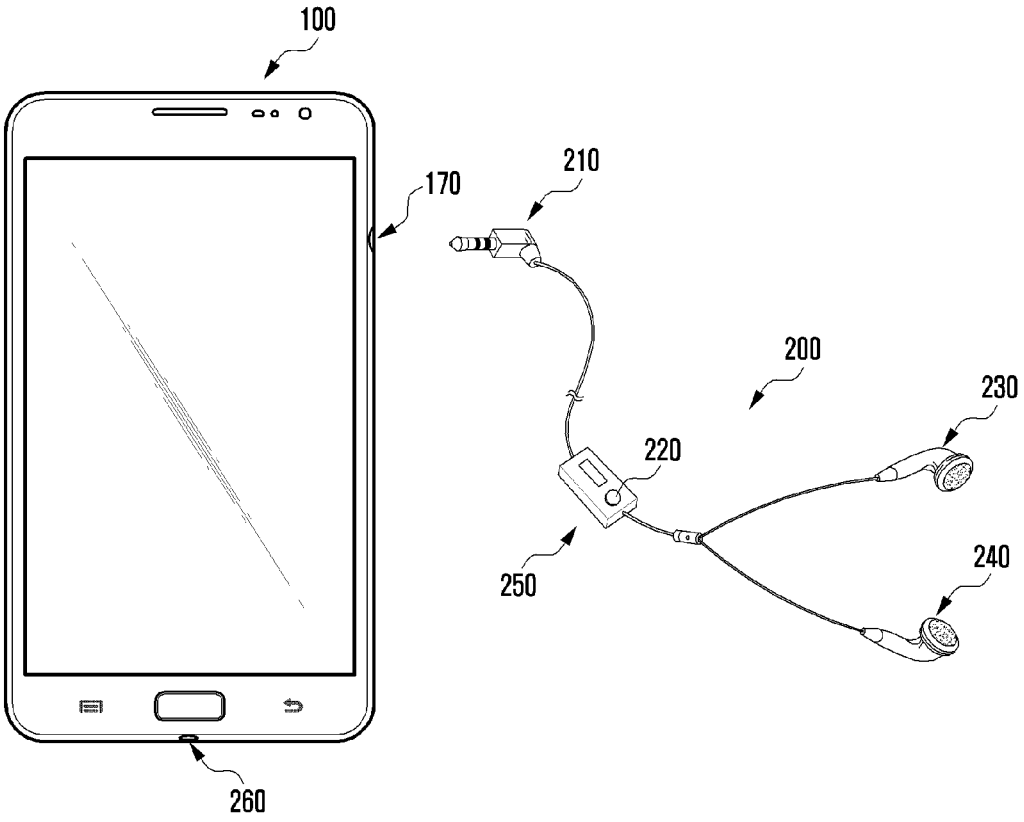
FIG. 1 illustrates a perspective view of an electronic device and an earphone device according to the present disclosure.
Figure 2:
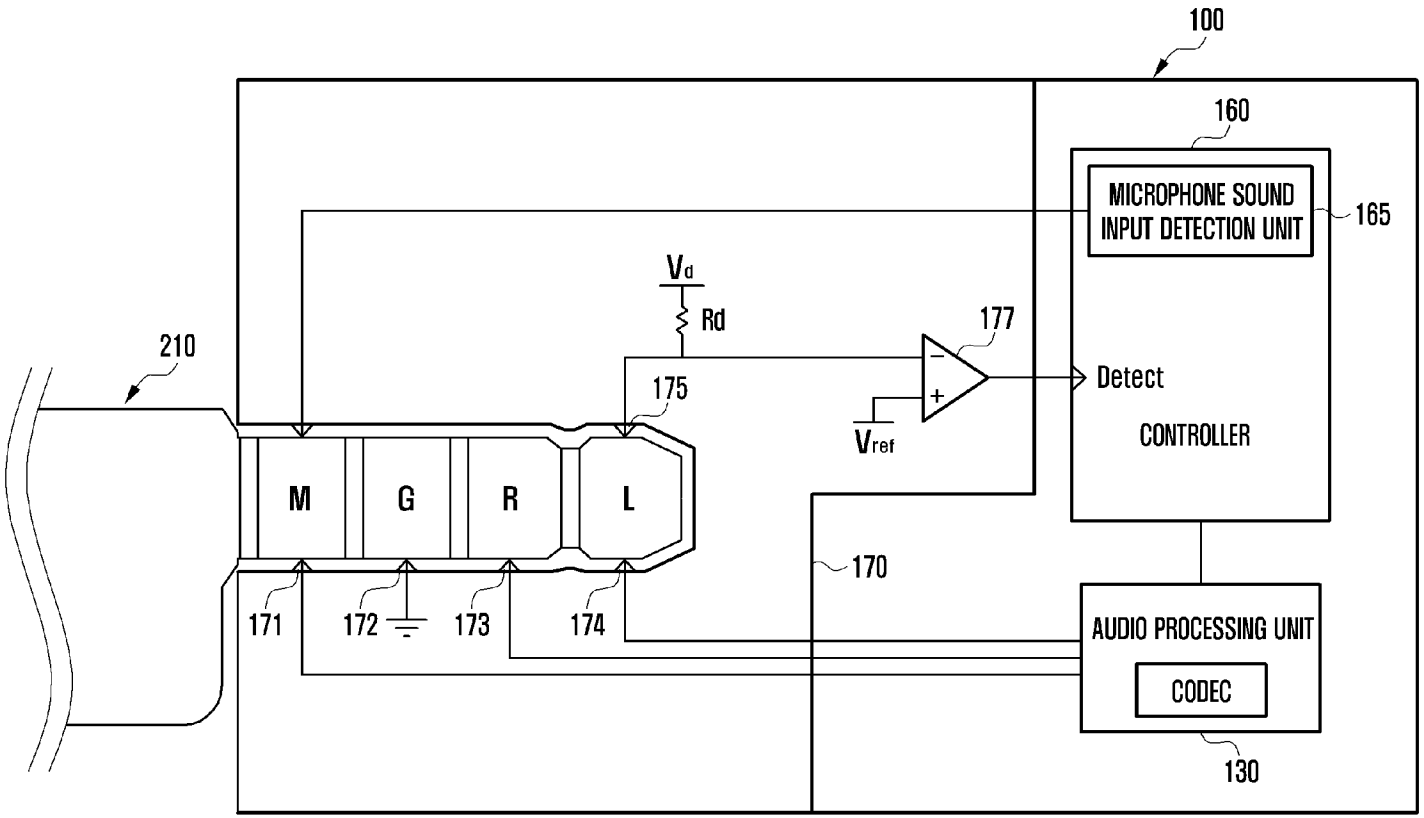
FIG. 2 illustrates a detailed configuration related to a state where an earphone device of the present disclosure is inserted to an electronic device.

FIG. 1 illustrates a perspective view of an electronic device 100 and an earphone device 200 according to the present disclosure, and FIG. 2 illustrates in more detail a configuration related to a state where an earphone device 200 of the present disclosure is inserted to an electronic device 100.

Referring now to FIG. 1 and FIG. 2, an earphone system 10 of the present disclosure may include an electronic device 100 and an earphone device 200.

The configurations in accordance with the present disclosure may include a microphone sound input detection unit 165, piezoelectric or electro-restrictive sensor, for example, which detects a sound input through an earphone microphone 220 in an electronic device 100, and may control the sound input path when the earphone device that malfunctioning is inserted into the electronic device 100, and provides support for a function determining the sound input device adaptively as at least one of other devices including a microphone 260 that is built-in the electronic device 100.

In this case, an audio signal playing in the electronic device 100 or an audio signal received from the external sound may be output through an earphone of a left side output unit 230 or an earphone of a right side output unit 240 of the earphone device 200. However, a sound/audio signal input to the electronic device 100 may be received through a path connected to at least one of other devices including the microphone 260 built in the electronic device 100.

Here, with continued reference to FIG. 1, the earphone device 200 may include an earphone head 210 inserted into an earphone interface 170 of the electronic device 100, and the earphone output units 230, 240, which output the audio signal, connected to the earphone head 210. In addition, when the earphone device 200 is configured with O-pole, it may include an earphone microphone 220, and may include a control module 250 to generate an input signal of the earphone device 200 including a case that includes the earphone microphone 220 and a printed circuit board.

Here, the earphone head 210 may include 3 or 4 poles depending on the design type of the earphone device 200. In other words, such as shown in FIG. 2, in the case of the 4-pole earphone, the earphone head 210 may basically include an earphone left terminal (L), an earphone right terminal (R), and an earphone grounding terminal (G), and may further include an earphone microphone terminal (M). Such an earphone head 210 may be provided as an attachable type, that is, a cylindrical type of a certain diameter to the earphone interface 170 of the electronic device 100, and may be attached to or detached from the earphone interface 170 by exerting pressure.

The earphone output units 230, 240 may include an earphone left side output unit 230 which is connected to the earphone left side terminal (L) and outputs a left side audio signal, and an earphone right side output unit 240 which is connected to the earphone right side terminal (R) and outputs a right side audio signal. When the outputted audio signal is formed as a stereo type output, the earphone output units 230, 240 may divide the left side and the right side to output the audio signal respectively, and, when the audio signal is formed as a mono type output, then, the earphone outputs unit may output the audio signal to the left and right side output units 230, 240 without dividing the left and right sides. Here, the earphone left side output unit 230 may have a specific resistance value of several ohms, for example, resistance value of 32 ohms. The earphone right side output unit 240 may also have 32 ohms resistance value which is a speaker's own specific resistance value.

Each resistance value of the earphone left side output unit 230 and the earphone right side output unit 240 may be varied according to the speaker characteristics of the corresponding earphone device 200. In other words, when the earphone device 200 supports for an audio listening function having the higher specifications or the lower specifications, the materials used to provide support for the corresponding specifications may be varied, and as a result, the specific resistance value of each earphone output unit 230, 240 may be varied depending on a dissimilarity of the materials, a disposition or an accuracy of the components.

The control module 250 is disposed between the earphone head 210 and the earphone output unit 230, 240, and comprises circuitry that connects the specific terminal of the earphone head 210 to each output unit of the earphone output units 230, 240, and provides a space where the microphone 220 device may be mounted. In addition, the control module 250 may further include specific buttons/switches according to a function support of the earphone device 200, and may generate an input signal corresponding to the specific button press, and may send the input signal to the controller 160 of the terminal 100 through the earphone interface 170 connected to the earphone head 210.

Still referring to FIG. 2, the electronic device 100 may include the earphone interface 170 to which the earphone device 200 is inserted, the controller 160, and an audio processing unit 130, which may comprise a codec, and may further include a communication unit and a storage unit.

The electronic device 100 having such configuration as shown and described in FIG. 2 may detect whether the earphone microphone 220 is operating normally when the earphone head 210 is connected to the earphone interface 170, and may control the sound input path according to the normal operation of the detected earphone microphone 220. In other words, when the electronic device 100 determines that the earphone microphone 220 is operating normally, the earphone microphone 220 is determined by the electronic device 100 to be the sound input device. In addition, when the earphone microphone 220 is determined by the electronic device 100 to be operating abnormally, other devices, such as a pre-set built-in microphone 260 except for the earphone microphone 220 is decided to be the sound input device.

Accordingly, even when the earphone stops working or does not operate normally due to a dirt that has accumulated in the earphone interface 170, or even when a certain type of the earphone is not able to be distinguished because of a variation of the electronic signal read in the microphone terminal (M) part of the earphone due to a circuit design of the electronic device by an earphone manufacturer, it is possible to increase the stability r of the sound received by the input by the electronic device 100.

In still more detail and with continued reference to FIG. 2, the electronic device 100 of the present disclosure may check whether the earphone device is connected by detecting whether a recognition contacting unit 175 equipped in the earphone interface 170 is in contact with the earphone left side terminal (L). Here, the recognition contacting unit 175 can be utilized for the connection of the resistances of the earphone device 200 connected to the earphone left side terminal (L), and its position can be changed. In other words, the recognition contacting unit 175 may be connected to the earphone right side terminal (R) depending on a designer's preference. The earphone left side terminal (L) and the earphone right side terminal (R) may be included in a general earphone device such as a 3-pole earphone or a 4-pole earphone.

When the electronic device 100 has determined that the earphone device 200 is connected by the recognition contacting unit 175, the microphone sound input detection unit 165 is activated, so that the sound input through the earphone microphone 220 may be detected. The microphone sound input detection unit 165 may be operated automatically or manually according to a user request or a designer setting.

For example, when an application requiring a sound input data is executed in a state in which the earphone device 200 is inserted in the earphone interface 170, a circuit which determines the generation of the sound signal input through the earphone microphone 220 captures a data of 4 clock cycles to determine whether the sound signal has generated, and may send the determination result to the controller 160. The generation of the sound signal may be detected in a path connected from the earphone microphone 220 to a codec. In other words, after capturing and analyzing data of a preset certain cycle in the state in which the 4-pole earphone device having a microphone is inserted into the earphone interface 170, when it is determined that the sound signal is generated, the electronic device 100 determines that the earphone microphone of the 4-pole earphone device is operating normally, and may determine the earphone microphone as the sound input device of the electronic device 100.

On the contrary, after capturing and analyzing data of a preset certain cycle in the state in which the 4-pole earphone device having a microphone is inserted into the earphone interface 170, when the controller 160 determines that the sound signal is not generated, the electronic device 100 may determine that the earphone microphone is in an abnormal state. For example, when the earphone microphone of the 4-pole earphone device is broken down or the earphone type cannot be distinguished due to a variation of the electronic signal read in the earphone microphone terminal (M) part, the electronic device 100 recognizes this lack of functionality as an abnormal state, then designates the built-in microphone 260 in the electronic device 100 as being the sound input device. In this particular case, even if the microphone 260 built-in the electronic device 100 is selected as the sound input device, the audio signal played in the electronic device 100 or the audio signal received from an external sound may be output through the earphone left side output unit 230 and the earphone right side output unit 240.

Meanwhile, since the sound input signal detected by the microphone sound input detection unit 165 does not exist in the state in which the 3-pole earphone device (the 3 pole earphone has only left, right and ground, and does not have a microphone) is inserted into the earphone interface 170, the electronic device 100 may determine the built-in microphone 260 or other device as the sound input device. In addition, the audio signal played (generated) in the electronic device 100 or the audio signal received from an external source may be output through the earphone left side output unit 230 and the earphone right side output unit 240.

With reference to FIGS. 1 and 2, the earphone interface 170 may include an insertion hole to which the earphone head 210 is inserted and several terminal contacting units to support for the connection of the earphone device 200 having the 3-pole or the 4-pole polarity in the inside of the insertion hole. In particular, as shown in FIG. 2, the earphone interface 170 may include terminal contacting units 171, 172, 173, 174 to respectively recognize four polarities in a specific position, and a recognition contacting unit 175 to recognize a connection of the earphone device 200. The terminal contacting units 171, 172, 173, 174 may include the contacting units that respectively contact with the earphone microphone terminal (M) of the earphone head 210, the earphone grounding terminal (G), the earphone left side terminal (L), and the earphone right side terminal (R).

The recognition contacting unit 175 is the contacting unit which can contact to the earphone left side terminal (L). Here, the recognition contacting unit 175 is utilized to connect the resistances of the earphone device 200 connecting to the earphone left side terminal (L), and its position can be changed. In other words, the recognition contacting unit 175 may be connected to the earphone right side terminal (R) depending on the designer's intent.

Meanwhile, the earphone interface 170 may also include a distribution resistance (Rd) which is connected in parallel to at least one of the resistances on the line that is connected to the earphone left side terminal (L) of the earphone head 210 to distribute a full-up voltage (Vf), and a comparator 177 which outputs a result value according to the input distribution voltage.

The controller 160, which comprises hardware circuitry that may include integrated circuits such as a processor or microprocessor, may include a detection port (Detect) connected to an output of the comparator 177, and may recognize the connection of earphone device 200 according to the signal sent to the detection port (Detect).

When the controller 160 recognizes that the earphone device 200 is connected according to a check of the signal sent to the detection port, the controller 160 may control to determine the sound input device of the electronic device 100 by controlling the microphone sound input detection unit 165.

In addition, the controller 160 may check the detection result of the microphone sound input detection unit 165, and, when it is determined that the sound input through the earphone microphone is not being output (or does not exist), and the controller may control the audio processing unit 130 and notify the related information to the user, or may determine the microphone built-in the electronic device 100 or other device (not shown) as the sound input device, and may select a path that connects the determined sound input device to the controller 160.

The audio processing unit 130 comprises hardware circuitry that can be integrated such as a microprocessor or processor being configured to support an audio output function and an audio collecting function of the earphone device 200 implemented in the earphone interface 170 under the control of the controller 160, and supporting the audio collecting function of the microphone 260 built-in the electronic device 100 or a receiver.

When the audio processing unit 130 receives the signal informing that earphone microphone 220 is determined as being the sound input device from the controller 160, the audio processing unit 130 may support receiving the sound signal generated from an external source of the electronic device 100 through the earphone microphone 220.

In addition, when the earphone microphone 220, the microphone 260 built in the electronic device, or another device is selected as the sound input device by the controller 160, the audio processing unit may support receiving the sound signal generated from the external source of the electronic device 100 through the selected sound input device.

In addition, when receiving a request for the audio collecting function to support the function of the electronic device 100 from the controller 160, the audio processing unit 130 may perform a signal processing for the audio signal collected through the sound input device determined by the controller 160 as described above, and may send to the controller 160. Alternatively, the audio processing unit may send the signal processed audio signal to the storage unit or the communication unit under the control of the controller 160.

As described above, when the earphone device is inserted into the electronic device 100, the sound input function of the electronic device is normally performed at all times by using various sound input devices selectively regardless of a type of the earphone device or an abnormal operating state of the earphone microphone.

Figure 3:
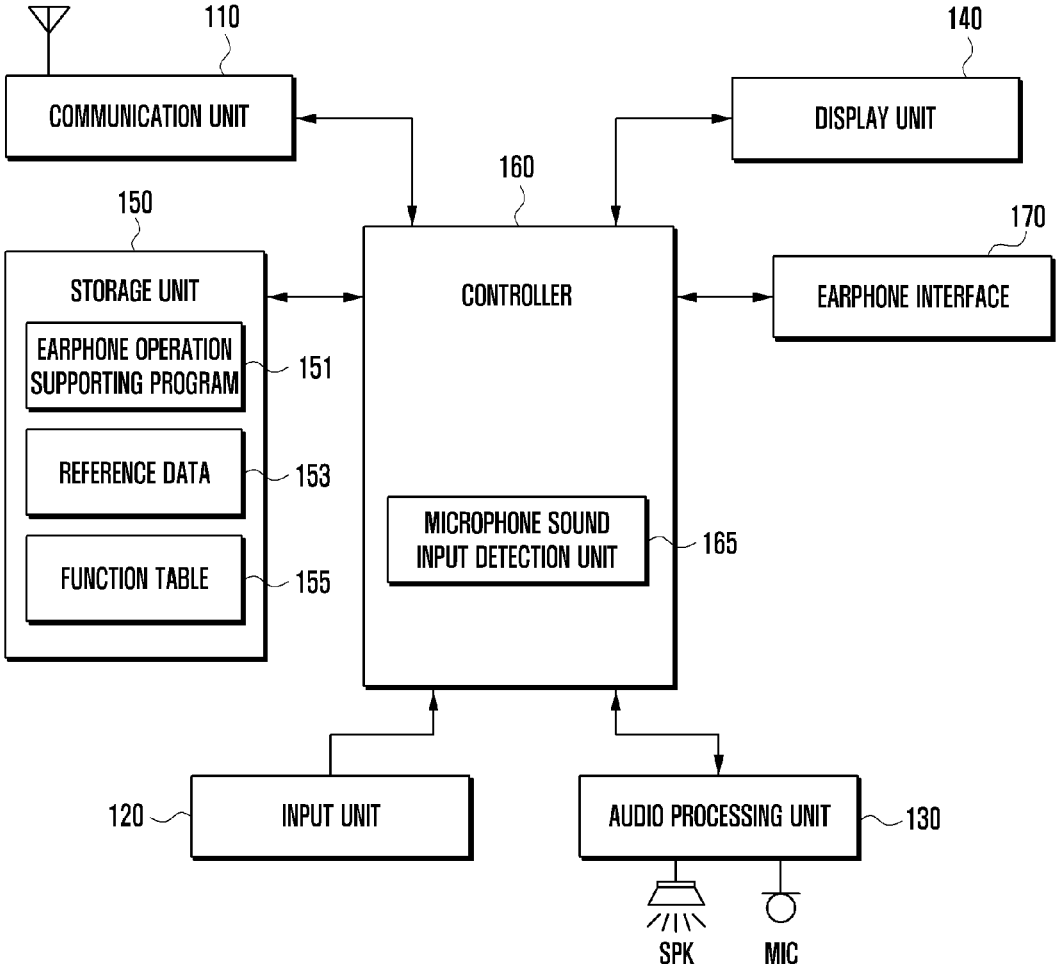
FIG. 3 illustrates a detailed schematic of an electronic device according to an embodiment of the present disclosure.

FIG. 3 illustrates a detailed configuration of one way an electronic device according to an embodiment of the present disclosure may be structured.

Referring now to FIG. 3, the electronic device 100 of the present disclosure includes the following hardware: a communication unit 110, an input unit 120, an audio processing unit 130, a display unit 140, a storage unit 150, an earphone interface 170, and a controller 160. The controller 160 may include a microphone sound input detection unit 165.

The electronic device 100 including such configuration may execute the microphone sound input detection unit 165 to check an operation of the earphone microphone when the earphone device is inserted into the earphone interface 170. In addition, the electronic device 100 may select the sound input device in response to a result of the microphone sound input detection unit 165 obtained according to a setting event, and may control to set a path of a corresponding sound input.

Here, the setting event may be at least one of a certain cycle advent after the insertion of the earphone device, a real-time, or a user request signal generation.

The communication unit 110 is utilized for supporting a communication function of the electronic device 100, and may be implemented when the electronic device 100 is designed to perform the communication function. The communication unit includes structure such as a transmitter, receiver and/or a transceiver, as well as an antenna or antenna array. Therefore, when the electronic device 100 does not provide support for the communication function, the communication unit 100 may be excluded. Meanwhile, the communication unit 110 may support for the various communication functions of the electronic device 100, for example, a mobile communication function and a short distance wireless communication function, and the like. In other words, the device may transmit using protocols such as LTE, and also include short-range capabilities such as 802.11XX, as well as Bluetooth or NFC, just to name some non-limiting possibilities.

Thus, when the electronic device 100 is designed to support a plurality of communication functions, the communication unit 110 may include a communication module to support for each communication function. All of the communication modules herein do not constitute pure software or software per se and are loaded into hardware circuitry for operation, such as a microprocessor, processor, or controller, to configure operation of same. For example, in order to support for the mobile communication function, the communication unit 110 may include at least one of mobile communication modules such as 2G, 3G, and 4G. In addition, the communication unit 110 may include at least one or more of a Bluetooth module, NFC module, or RFID module to support for the short distance wireless communication function.

Meanwhile, the communication unit 110 may be activated or deactivated adaptively under the control of the controller 160 depending on the mounting of the earphone device 200. For example, the communication unit 110 is activated in the state in which the earphone device 200 is mounted and may form a communication channel with another terminal having a pre-defined specific telephone number or another terminal having a specific telephone number pre-selected by a user. The communication unit 110 may have a deactivated state that occurs automatically when the earphone device 200 is changed from a wearing state to a non-wearing state. For example, when a call connection and earphone device 200 wearing state is changed into the non-wearing state, a signal for terminating the call connection may be transmitted through the communication unit 110. Alternatively, when the earphone device insertion is released in the state in which the call is connected, the audio signal received by the communication unit 110 may be output automatically through a speaker (SPK). A function selection according to such earphone device 200 insertion or the insertion release may be adjusted according to a user setting, and the electronic device 100 may provide a screen interface for a setting adjustment.

With continued reference to FIG. 3, the input unit 120 generates an input signal that is necessary to operate the electronic device 100. The input unit 120 may be configured in any of a number of ways, for example, with a hardware physical key type such as a home key, a side key, and a power supply key, and the like. In addition, the input unit 120 may be configured with virtual keys outputted to the display unit 140 when the display unit 140 is provided with a touch screen type display.

Such an input unit 120 may generate an input signal for activating a sound input path control mode of the electronic device as a default, and an input signal for deactivating a sound input path control mode of the electronic device that is applied as a default based on the microphone sound input detection unit 165 of the present disclosure according to a user control or a manufacturer design.

In addition, according to the user control, the input unit 120 may generate a screen call input signal for a setting of the sound input path control mode, an input signal for selecting at least one of an electronic device functions to which the sound input path control mode is to be applied, and an input signal for a mode release of the electronic function where the sound input path control mode of the electronic device is set.

The electronic device 100 may support output of a setting screen for the setting of the sound input path control mode to the display unit 140 when receiving each input signal, and may set at least one of the electronic device functions according to the additional input signal so that the sound input path control mode of the present disclosure may be applied, or may control to release the setting state. The above described input signals are provided to the controller 160 after its generation, and may be changed or applied by a command language to support for the corresponding input signal function.

The audio processing unit 130 supports at least one of an output of the audio signal or a collection of the audio signal related to the operation of the electronic device 100 of the present disclosure. The audio processing unit 130 includes hardware circuitry, such as a processor, microprocessor, or subprocessor that may include integrated circuits, and may include a speaker (SPK) to output the audio signal and a microphone (MIC) to collect the audio signal. The audio processing unit 130 may support for an output of a guiding sound that guides the sound input path control mode state of the electronic device.

In particular, when at least one of the earphone microphone, a microphone built-in the electronic device 100, or other device including a receiver is determined as the sound input device, the audio processing unit 130 may support for an output of a "beeping" sound that guides corresponding information to the user.

In addition, the audio processing unit 130 of the present disclosure provides support for an audio output function and an audio collecting function of the earphone device 200 mounted in the earphone interface 170 under the control of the controller 160, and supports for the audio collecting function of the microphone 260 built-in the electronic device 100 or the receiver.

When the audio processing unit 130 receives a signal from the controller 160 that indicates that the earphone microphone 220 is determined to be the sound input device, the audio processing unit 130 may receive sound signals generated from the external of the electronic device 100 through the earphone microphone 220.

Furthermore, when the earphone microphone 220, the microphone 260 built-in the electronic device 200, or another device is selected by the controller 160 as being designated as the sound input device, the audio processing unit 130 may provide support to receive the sound signal generated from the external of the electronic device 100 through the selected sound input device.

Furthermore, when the audio processing unit 130 receives an audio collecting function request to provide support for the function of the electronic device 100 from the controller 160, the audio processing unit 130 may signal process the audio signal collected through the sound input device determined by the controller 160 as described above, and may send to the controller 160. Alternatively, the audio processing unit 130 may send the signal processed audio signal to the storage unit or the communication unit 110 under the control of the controller 160.

The display unit 140 is an element for outputting various screens related to the operation of the electronic device 100 of the present disclosure, and may be comprised of any of the various technologies, for example thin film technology (TFT), OLED, LED, LCD, just to name a few possibilities. For example, the display unit 140 may output a standby screen or a menu screen, and the like according to the electronic device 100 operation. In addition, according to the user request or the preset schedule information, the display unit 140 may output a specific screen according to the screen related to the electronic device 100 function operation, such as a sound call function performing screen, a video call function performing screen, a phonebook screen, an audio file playing screen, a broadcasting receiving screen, and a video playing screen.

Meanwhile, the display unit 140 of the present disclosure may provide an output of information related to the earphone device 200 mounting and the operating of the earphone microphone 220 as the specific image or a text to a certain screen area. For example, the display unit 140 may output image information related to the earphone device 200 mounting and the operating of the earphone microphone 220 to an indicator area.

In addition, the display unit 140 may output text information related to the earphone device 200 mounting and the operating of the earphone microphone 220 to a certain screen area as a pop-up window. Along with this output of text information, for example, the display unit 140 may output the information related to a function which is able to be operated according to the earphone device 200 mounting and the operating of the earphone microphone 220.

The storage unit 150 stores various programs and a data related to the electronic device 100 operation. For example, the storage unit 150 is comprised of a non-transitory medium and may store an operating system related to the electronic device 100 operation, a communication function supporting application program to operate the communication unit 110, and a program to support a broadcasting reception function, and may store data generated according to each function operation. In particular, the storage unit 150 may store, for example, the earphone operating supporting program 151, a function table 155, and a reference data 153 to support for the sound input path control mode of the present disclosure.

The earphone operating supporting program 151 may include various routines that when loaded into hardware such as a microprocessor or controller and executed will operate to support and perform a specific electronic device function adaptively according to the earphone device 200 mounting and the operating of the earphone microphone 220 of the present disclosure.

For example, the earphone operating supporting program 151 may include a routine that detects whether or not the earphone device 200 is mounted, and a detection routine that detects whether the function of the earphone microphone 220 can be operated. Here, the detection routine that detects the wearing of the earphone device 200 may include a routine transmitting a detection signal of the recognition contacting unit 175, a routine comparing a detection signal of the recognition contacting unit 175 with a reference data 153, and a routine determining the wearing of the earphone device 200 based on the comparison result. Again, such routines as discussed herein above are executed by hardware configured for operation, such as a controller, sub-controller, processor, sub-processor, etc.

The routine that detects the operation of the earphone microphone 220 may include a routine transmitting a detection signal of the microphone sound input detection unit 165.

In addition, the earphone operating supporting program 151 may include a sound input path control routine controlling to change the sound input path of the electronic device adaptively or maintain the previous state according to the detection result of the microphone sound input detection unit 165. Such a sound input path control routine may include a routine checking a type of the electronic device function, and a routine adjusting the electronic device function according to the detection of the microphone sound input with reference to a function table 155.

The function table 155 is the table that stores by mapping types of various functions of the electronic device 100 to various schedule information to be performed according to the microphone sound input detection when setting the sound input path control mode of the electronic device.

For example, the function table 155 may include activation control information of the microphone 260 built-in the earphone microphone 220 or the electronic device 100 according to the detection of the microphone sound input, and information determining the sound signal input path according to the activated sound input device.

When the earphone device 200 is inserted into the earphone interface 170, in this example, the function table 155 is called from the controller 160 and may be used to support the functions according to the performing of the specific function and the detection of the microphone sound input. An artisan should understand and appreciate that the function table 155 disclosed in this embodiment does not limit the appended claims as other arrangements can be used. The reference data 153 may utilized to check the detection of the sound input through the earphone microphone 220.

The earphone interface 170 receives the earphone device 200, which is inserted into an opening in the interface. To this end, the earphone interface 170 may be provided with a groove of a certain predetermined size that corresponds to the size of an earphone jack 203 of the earphone device 200. Some interface terminals are disposed in the inside of the earphone interface 170 so that the interface terminals may be contacted to terminals formed in the earphone jack 203. For example, as illustrated in FIG. 2, the earphone interface 170 may include a MIC terminal, an OPEN_DET terminal, an EARSK_L terminal, an EARSPK_R terminal, and a grounding terminal (GND), and may further include a terminal which is not separately used. The OPEN_DET terminal may be the terminal checking the insertion of the earphone.

In particular, the microphone terminal (M) 171 among the terminals provided in the earphone interface 170 of the present disclosure may be used for the sound input detection input through the earphone microphone 220. To this end, the microphone terminal M may be connected to the microphone sound input detection unit 165, as shown in FIG. 2.

The controller 110, which is configured for operation may control the overall operation of the electronic device 100 and a signal flow between the internal blocks of the electronic device, and may perform a data processing function processing the data. This controller 110 is hardware comprised of integrated circuitry such as a Central Processing Unit (CPU) and an Application Processor (AP).

The controller 160 may support for a signal control for supporting a terminal application control mode, a data processing, a data transmission, a function control, and a processing to check a state of a non-powered sensor for a function control. To this end, the controller 160 may be configured as illustrated in FIG. 3.

When the controller 160 recognizes that the earphone device 200 is connected, according to the check of detection port (Detect) connected to the earphone interface 170, the controller 160 may control to determine the sound input device of the electronic device 100 by controlling the microphone sound input detection unit 165.

In other words, the controller 160 can be configured to check the detection result of the microphone sound input detection unit 165, and, when it is recognized that the sound input through the earphone microphone does not exist, then, the controller may notify corresponding information to the user by controlling the audio processing unit 130, or may determine the microphone built-in the electronic device 100 or other device (not shown) is the sound input device, and select a path connecting the determined sound input device to the controller 160.

The controller 160 may select at least one of a plurality of other devices in addition to the earphone microphone 220 and the built-in microphone 260 as the sound input device of the electronic device 100 according to the detecting result of the microphone sound input detection unit 165. Moreover, the controller 160 may receive the sound signal generated from the external through the selected sound input device.

A method for controlling the sound input path of the controller 160 will be described in below with reference to FIGS. 4 and 5.

Figure 4:
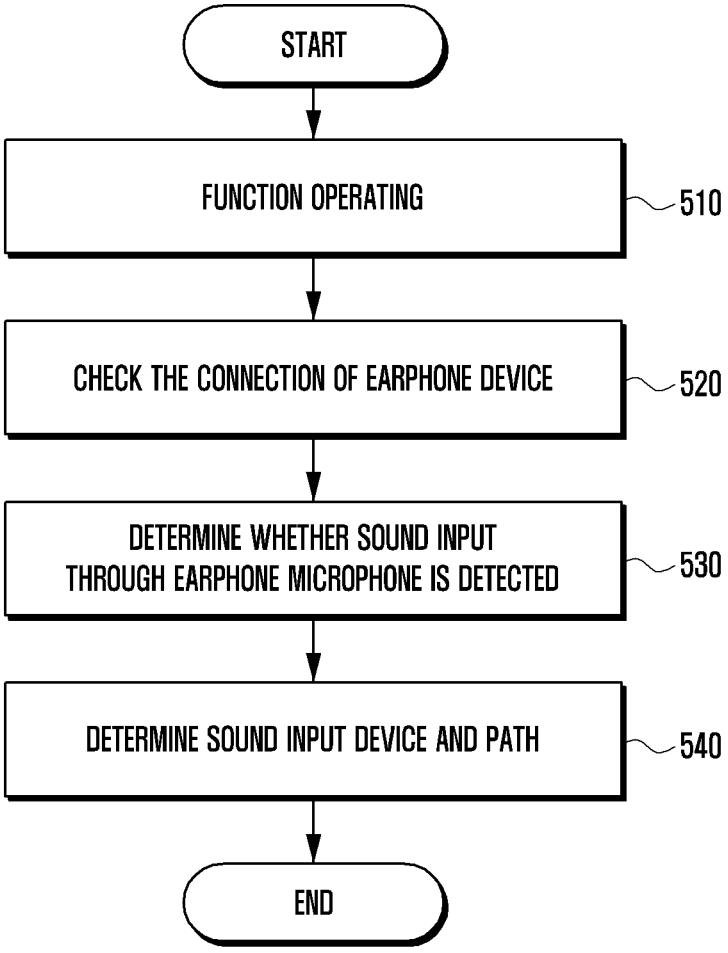
FIG. 4 is a flowchart schematically illustrating an operational example of a method for controlling a sound input path according to the present disclosure.

FIG. 4 is a flowchart schematically illustrating one way a method for controlling a sound input path according to the present disclosure can operate.

Referring now to FIG. 4, at operation 510, in the method for controlling the sound input path of the present disclosure, first, the controller 160 of the electronic device 100 may be configured for performing a procedure for the function operating or the function operating standby.

In other words, the controller 160 may provide support for supplying power from a power supply unit to the certain portions of the electronic device 100 to operate the electronic device 100. In addition, the controller 160 may operate at least one application by a user input. The application may be at least one of applications which receive the sound input from the external, for example, a call application, a sound search application, and a sound command application.

Next, at operation 520, the controller 160 may check the connection of the earphone device.

Here, the controller 160 may check the connection of the earphone device by checking whether the device having an element such as the earphone head is inserted to the earphone interface regardless of a whether the earphone device is a 3-pole type or a 4-pole type.

Next, at operation 530, the controller 160 may determine whether the sound input through the earphone microphone is detected.

For example, by determining that a sound input transmitted through the path connected from the earphone microphone of the earphone having the microphone such as the 4-pole earphone to the codec exists, the controller 160 may determine that the earphone microphone is able to be operated (i.e. operational). On the contrary, if there is no sound input signal at the codec (the sound input transmitted through the path connected from the earphone microphone to the codec) then, the controller may determine that the earphone microphone is not operational (malfunctional).

Here, the operation of the earphone microphone may be determined over a preset certain cycle after checking that the earphone device is connected at operation 520, or determined by the user request, or determined automatically by the designer's setting, or may be determined by the operation of the application executed in the electronic device 100.

With continued reference to FIG. 4, at operation 540, the controller 160 may determine the sound input device and the sound input path. For example, the controller 160 may select the sound input device and the sound input path of the electronic device 100 based on the sound input detection through the earphone microphone that was detected at operation 530.

In particular, when it is determined that the sound input through the earphone microphone is detected, the controller may determine the earphone microphone as being the designated sound input device, and on the contrary, when it is determined that the sound input through the earphone microphone is not detected, then, the controller may determine another device, such as the preset built-in microphone 260, except for the earphone microphone as being the sound input device.

In the above, the method for controlling the sound input path according to the present disclosure was schematically described. Hereinafter, the method for controlling the sound input path according to the sound input detection input through the earphone microphone will now be described in more detail.

Figure 5:
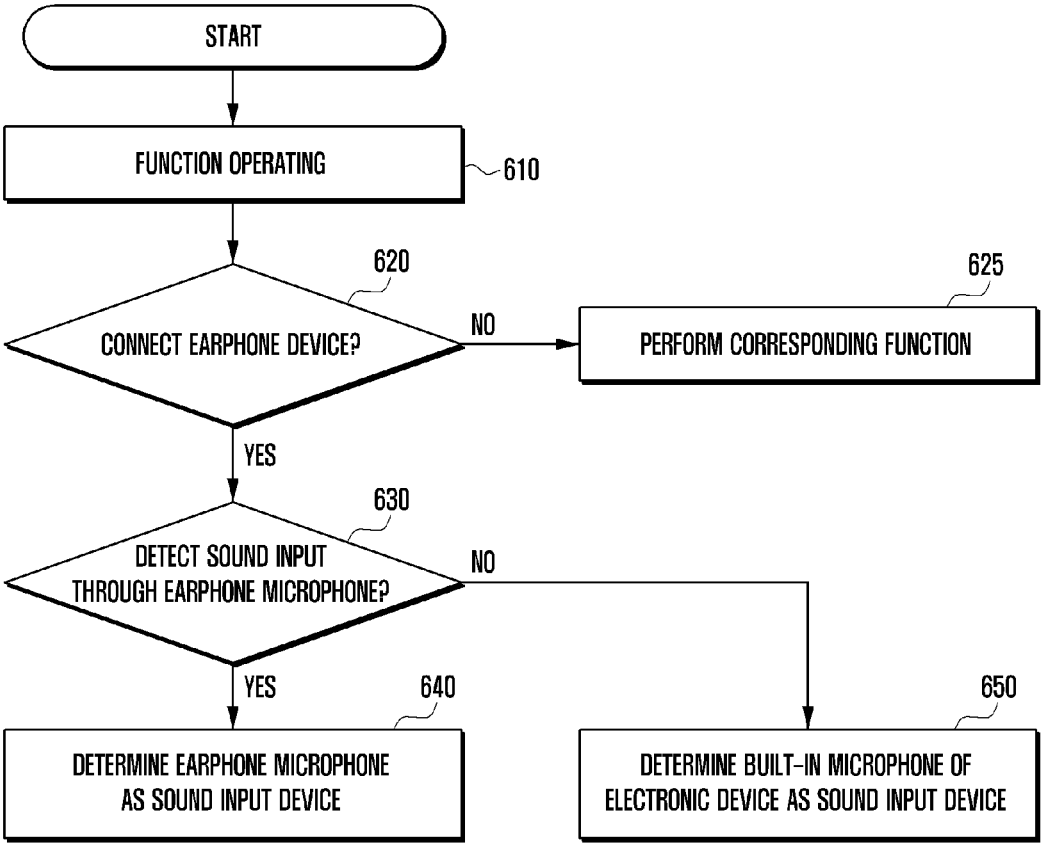
FIG. 5 is a flowchart illustrating an operational example of a method for controlling a sound input path according to the present disclosure.

FIG. 5 is a flowchart illustrating exemplary operation of a method for controlling a sound input path according to the present disclosure.

Referring now to FIG. 5, at operation 610, in the method for controlling the sound input device of the present disclosure, the controller 160 of the electronic 100 may perform the function currently operating or perform a standby function.

For example, the controller 160 may provide support for controller supply of power from the power supply unit to the certain portions of the electronic device 100 for the execution of application. In addition, the controller 160 may operate at least one application by the user request. The application may be the application including the function receiving the sound input from the external.

Next, at operation 620, the controller 160 may check whether the earphone device is connected.

For example, the connection of the earphone device may be checked by detecting that a recognition contacting unit 175 equipped in the earphone interface 170 is contacted to the earphone left side terminal (L). Here, the recognition contacting unit 175 is utilized for connecting the resistances of the earphone device 200 connected to the earphone left side terminal (L), and its position can be changed. In other words, according to the designer's intent, the recognition contacting unit 175 may be connected to the earphone right side terminal (R). The earphone left side terminal (L) and the earphone right side terminal (R) may be an element including a general earphone such as the 3-pole earphone or the 4-pole earphone.

Next, at operation 630 when the controller checks that the earphone device is connected at operation 620, the controller 160 may determine whether the sound input through the earphone microphone is detected.

In particular, the microphone sound input DETECTION UNIT 161 may detect the sound input which is input through the earphone microphone, and may send the detection result to the controller 160. For example, when the application that needs the sound input data is executed in the state in which the earphone device 200 is mounted in the earphone interface 170, a circuit determining the sound signal input through the earphone microphone may capture the data of 4 clock cycle to determine the generation of the sound signal, and may send the determination result to the controller 160.

At operation 640, when the controller 160 detects that the sound is input by the microphone sound input DETECTION UNIT 161 at operation 620, the controller 160 may determine the earphone microphone as being the sound input device.

On the contrary, at operation 650, when the controller 160 detects that the sound is not input by the microphone sound input DETECTION UNIT 161 at operation 620, the controller 160 may determine at least one of the built-in microphone of the electronic device 100 or other device as the sound input device.

According to an embodiment of the present disclosure, the method for controlling the sound input path and the electronic device supporting the same, as described above, provides support to perform the sound input function of the electronic device adaptively according to the normal operation of the earphone microphone.

Meanwhile, the above described electronic device 100 may further include various additional modules (which comprise machine executable code that is loaded into hardware and executed for operation) according to its providing types. In other words, the electronic device may further include components which are not mentioned in the above such as an interface to transmit and receive a data by a wired communication method or a wireless communication method of the electronic device 100 and an internet communication module performing an internet function by communicating with an internet network. Such components may be variously modified according to the trend of digital convergence, and thus not all such components may be listed here, but components of the same level as that of the above-mentioned constituent elements may be further included. In addition, specific constructions of the electronic device 100 of the present disclosure may be excluded from the above configuration or may be replaced with other configuration according to its providing type. This can be easily understood to those of ordinary skilled in the art.

In addition, the electronic device 100 according to an embodiment of the present disclosure may include all information communication device, a multimedia device, and a corresponding application device such as a Portable Multimedia Player (PMP), a digital broadcasting player, a Personal Digital Assistant (PDA), a music player (e.g., MP3 player), a portable game terminal, a smart phone, a notebook PC, and a hand held PC, etc. as well as all mobile communication terminals operated in accordance with a communication protocols corresponding to various communication systems.

A method for controlling a sound input path and an apparatus supporting the same of the present disclosure use various sound input devices adaptively regardless of a type of an earphone device, or an abnormal operation state of an earphone microphone, so that a sound input function of an electronic device may be normally performed.

The above-described embodiments of the present disclosure can be implemented in hardware, firmware or via the execution of software or computer code by hardware, in which the firmware, software of computer code can be stored in a non-transitory recording medium such as a CD ROM, a Digital Versatile Disc (DVD), a magnetic tape, a RAM, a floppy disk, a hard disk, or a magneto-optical disk or computer code downloaded over a network originally stored on a remote recording medium or a non-transitory machine readable medium and to be stored on a local recording medium, so that the methods described herein can be rendered via such software that is stored on the recording medium and loaded into hardware having circuitry that is used in general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. Any of the functions and steps provided in the Figures may be implemented in hardware, software in conjunction with hardware or a combination of both and may be performed in whole or in part within the programmed instructions of a computer. No claim element herein is to be construed under the provisions of 35 U.S.C.

112, sixth paragraph, unless the element is expressly recited using the phrase "means for".

In addition, an artisan understands and appreciates that under the broadest reasonable interpretation, a "processor", "microprocessor" or "controller" comprises hardware circuitry in the claimed disclosure that is configured for operation by the execution of machine executable code. Under the broadest reasonable interpretation, the appended claims constitute statutory subject matter in compliance with 35 U.S.C. §101.

The definition of the terms "unit" or "module" as referred to herein is to be understood as constituting hardware circuitry such as a processor or microprocessor that may comprise an integrated circuit configured for a certain desired functionality, or a communication module containing hardware such as transmitter, receiver or transceiver, or a non-transitory medium comprising machine executable code that is loaded into and executed by hardware for operation, in accordance with statutory subject matter under 35 U.S.C. §101 and do not constitute software per se.

Although exemplary embodiments of the present disclosure have been described in detail hereinabove, it should be clearly understood that many variations and modifications of the basic inventive concepts herein taught which may appear to those skilled in the present art will still fall within the spirit and scope of the present disclosure, as defined in the appended claims.

What is claimed is:

1. A method for controlling a sound input path in an electronic device having an earphone interface and a display unit, the method comprising:

detecting by a controller of the electronic device a connection of an earphone device to the earphone interface;

detecting whether sound is input through an earphone microphone of the earphone device, when detecting the connection of the earphone device;

selecting by the controller the earphone microphone as a sound input device for the electronic device, when detecting whether sound is input through the earphone microphone; and outputting, by the electronic device, text information, wherein the earphone interface includes a distribution resistance (Rd) which is connected in parallel on a line that is connected to an earphone left side terminal (L) of an earphone head of the earphone device to distribute a full-up voltage, and a comparator which outputs a result value according to an input distribution voltage, and wherein the outputting outputs the text information related to the connection of the earphone device and an operation of the earphone microphone in a certain area of the display unit through pop-up window.

2. The method of claim 1, wherein the detecting of whether sound is input through the earphone microphone comprises detecting whether a sound input is transmitted to a codec connected to the earphone microphone.

3. The method of claim 1, wherein the detecting whether sound is input through the earphone microphone comprises detecting a generation of the sound input by capturing a data of 4 clock cycle input through the earphone microphone.

4. The method of claim 1, wherein the detecting whether the sound is input through the earphone microphone is performed with a preset certain cycle, or performed by a user request, or performed automatically by designer's setting, or performed by an operation of a specific application.

5. The method of claim 1, when the sound input is not detected through the earphone microphone, the controller selecting a built-in microphone of the electronic device as the sound input device.

6. The method of claim 5, further comprising outputting an audio/voice signal being generated by the electronic device or outputting an audio/voice signal received from an external source through an output unit of the earphone device.

7. The method of claim 1 wherein the earphone device comprises a 4-pole type microphone.

8. The method of claim 1, further comprising performing by the controller a detecting as to whether the earphone device is being worn by a user by transmitting a detection signal of a recognition contacting unit, and comparing the detection signal of the recognition contacting unit with a reference data, determining whether the earphone device is being worn based on the comparing the detection signal with the reference data.

9. An apparatus for controlling a sound input path in an electronic device having a display unit, the apparatus comprising:

an earphone interface configured to sense a connection with an earphone device; and a controller configured to detect a sound input through an earphone microphone of the earphone device when sensing the earphone interface is in connection with the earphone device, and to select a sound input device for the electronic device according to a detection result, wherein the earphone interface includes a distribution resistance (Rd) which is connected in parallel on a line that is connected to an earphone left side terminal (L) of an earphone head of the earphone device to distribute a full-up voltage, and a comparator which outputs a result value according to an input distribution voltage, and wherein the electronic outputs text information related to the connection of the earphone device and an operation of the earphone microphone in a certain area of the display unit through pop-up window.

10. The apparatus of claim 9, wherein the controller is connected to a codec connected to the earphone microphone, and the controller is configured to detect a sound input sent from the earphone microphone to the codec.

11. The apparatus of claim 9, wherein the controller is configured to detect a generation of the sound input by capturing a data of 4 clock cycles input through the earphone microphone.

12. The apparatus of claim 9, wherein the controller is configured to detect a sound input through the earphone microphone by at least one of: an advent of a preset certain cycle, a user request, a designer's setting or an operation of a specific application, when sensing the connection.

13. The apparatus of claim 9, wherein the controller is configured to select a built-in microphone of the electronic device as the sound input device when there is no sound input detected through the earphone microphone.

14. The apparatus of claim 13, wherein the controller is configured to select the built-in microphone of the electronic device as the sound input device, and outputs an audio/voice signal generated in the electronic device or an audio/voice signal received from an external source through an output unit of the earphone device.

15. The apparatus according to claim 9, wherein the controller includes a microphone sound input detector that is in communication with a terminal contacting unit of the earphone device to detect where sound is input through the earphone microphone of the earphone device.

* * * * *